US008019614B2

(12) United States Patent
Takagi et al.

(10) Patent No.: US 8,019,614 B2
(45) Date of Patent: Sep. 13, 2011

(54) ENERGY SHAPING APPARATUS AND ENERGY SHAPING METHOD

(75) Inventors: Yoshiaki Takagi, Kanagawa (JP); Kok Seng Chong, Singapore (SG); Takeshi Norimatsu, Hyogo (JP); Shuji Miyasaka, Osaka (JP); Akihisa Kawamura, Osaka (JP); Kojiro Ono, Osaka (JP); Tomokazu Ishikawa, Osaka (JP)

(73) Assignee: Panasonic Corporation, Osaka (JP)

( * ) Notice: Subject to any disclaimer, the term of this patent is extended or adjusted under 35 U.S.C. 154(b) by 867 days.

(21) Appl. No.: 12/065,378

(22) PCT Filed: Aug. 31, 2006

(86) PCT No.: PCT/JP2006/317218

§ 371 (c)(1),
(2), (4) Date: Feb. 29, 2008

(87) PCT Pub. No.: WO2007/026821

PCT Pub. Date: Mar. 8, 2007

(65) Prior Publication Data

US 2009/0234657 A1 Sep. 17, 2009

(30) Foreign Application Priority Data

Sep. 2, 2005 (JP) ..... 2005-254357
Jul. 11, 2006 (JP) ..... 2006-190127

(51) Int. Cl.
*G10L 19/00* (2006.01)

(52) U.S. Cl. ..... 704/501; 704/503; 704/504; 704/220; 704/200.1; 381/22; 381/17; 381/23; 381/19; 341/50; 341/51; 700/94; 370/487

(58) Field of Classification Search ..... 704/500–504, 704/220, 200.1, 201, 270; 381/22, 17, 23, 381/119, 18, 328, 20, 104, 98, 19, 80; 341/50, 341/51; 700/94; 370/487
See application file for complete search history.

(56) References Cited

U.S. PATENT DOCUMENTS 6,122,619 A * 9/2000 Kolluru et al. ..... 704/500
(Continued)

FOREIGN PATENT DOCUMENTS

EP 1 565 036 8/2005

OTHER PUBLICATIONS

International Search Report issued Nov. 28, 2006 in the International (PCT) Application of which the present application is the U.S. National Stage.

(Continued)

*Primary Examiner* — Vijay Chawan
(74) *Attorney, Agent, or Firm* — Wenderoth, Lind & Ponack, L.L.P.

(57) ABSTRACT

A temporal processing apparatus includes: a splitter splitting an audio signal, included in the sub-band domain, into diffuse signals indicating reverberating components and direct signals indicating non-reverberating components; a downmix unit generating a downmix signal by downmixing the direct signals; BPFs respectively generating a bandpass downmix signal and bandpass diffuse signals; normalization processing units respectively generating a normalized downmix signal and normalized diffuse signals; a scale computation processing unit computing, on a predetermined time slot basis, a scale factor indicating the magnitude of energy of the normalized downmix signal with respect to energy of the normalized diffuse signals; a calculating unit generating scale diffuse signals; a HPF generating high-pass diffuse signals; an adding unit generating addition signals; and a synthesis filter bank performing synthesis filter processing on the addition signals and transforming the addition signals into the time domains.

20 Claims, 9 Drawing Sheets

U.S. PATENT DOCUMENTS

| | | | | |
|---|---|---|---|---|
| 6,128,597 | A * | 10/2000 | Kolluru et al. | 704/500 |
| 7,283,604 | B2 * | 10/2007 | De Man et al. | 378/4 |
| 7,394,903 | B2 * | 7/2008 | Herre et al. | 381/23 |
| 7,447,317 | B2 * | 11/2008 | Herre et al. | 381/23 |
| 7,450,727 | B2 * | 11/2008 | Griesinger | 381/119 |
| 7,573,912 | B2 * | 8/2009 | Lindblom | 370/487 |
| 7,613,306 | B2 * | 11/2009 | Miyasaka et al. | 381/22 |
| 7,668,722 | B2 * | 2/2010 | Villemoes et al. | 704/500 |
| 7,751,572 | B2 * | 7/2010 | Villemoes et al. | 381/23 |
| 7,756,713 | B2 * | 7/2010 | Chong et al. | 704/500 |
| 7,788,107 | B2 * | 8/2010 | Oh et al. | 704/500 |
| 7,813,933 | B2 * | 10/2010 | Martin | 704/502 |
| 7,840,401 | B2 * | 11/2010 | Pang et al. | 704/201 |
| 2004/0032960 | A1 * | 2/2004 | Griesinger | 381/104 |
| 2005/0074127 | A1 * | 4/2005 | Herre et al. | 381/20 |
| 2005/0141722 | A1 * | 6/2005 | Van De Kerkhof et al. | 381/23 |
| 2005/0157883 | A1 * | 7/2005 | Herre et al. | 381/17 |
| 2005/0180579 | A1 * | 8/2005 | Baumgarte et al. | 381/63 |
| 2006/0009225 | A1 * | 1/2006 | Herre et al. | 455/450 |
| 2006/0045291 | A1 * | 3/2006 | Smith | 381/119 |
| 2006/0085200 | A1 * | 4/2006 | Allamanche et al. | 704/500 |
| 2007/0002971 | A1 * | 1/2007 | Purnhagen et al. | 375/316 |

OTHER PUBLICATIONS

C. Faller et al., "*Efficient Representation of Spatial Audio Using Perceptual Parametrization*", Applications of Signal Processing to Audio and Acoustics, 2001 IEEE Workshop, pp. 199-202, 2001.

C. Faller et al., "*Binaural Cue Coding: A Novel and Efficient Representation of Spatial Audio*", Proc. of IEEE International Conference on Acoustics, Speech, and Signal Processing (ICASSP'02), vol. 2, pp. 1841-1844, 2002.

Herre et al., "*The Reference Model Architecture for MPEG Spatial Audio Coding*", 118th AES Convention, Barcelona, May 28-31, 2005.

Supplementary European Search Report (in English language) issued Feb. 4, 2011 in corresponding European Patent Application No. 06 79 7178.

* cited by examiner

ENERGY SHAPING APPARATUS AND ENERGY SHAPING METHOD

TECHNICAL FIELD

The present invention relates to energy shaping apparatuses and energy shaping methods, and more particularly to a technique for performing energy shaping in decoding of a multi-channel audio signal.

BACKGROUND ART

Recently, a technique referred to as the Spatial Audio Codec has gradually been standardized in the MPEG audio standard. This aims for compression and coding of a multi-channel signal which has very little amount of information and which provides a lively scene. For example, the AAC (Advanced Audio Coding) scheme, which has already been widely used as an audio scheme for digital TVs, requires bit rates of 512 kbps and 384 kbps per 5.1 ch. On the other hand, the Spatial Audio Codec aims for compression and coding of a multi-channel audio signal at very low bit rates, such as 128 kbps, 64 kbps, and further, 48 kbps (See Non-patent Reference 1, for example).

FIG. 1 is a block diagram showing an overall structure of an audio apparatus utilizing a basic principle of the Spatial Audio Codec.

An audio apparatus 1 includes an audio encoder 10 which performs spatial-audio-coding on a set of audio signals to output the coded signals, and an audio decoder 20 which decodes the coded signals.

The audio encoder 10 is intended for processing a multi-channel audio signal (for example, an audio signal with two channels of L and R) on a frame-by-frame basis shown in 1024 samples and 2048 samples, and includes a downmixing unit 11, a binaural cue extracting unit 12, an encoder 13, and a multiplexing unit 14.

The downmixing unit 11 generates a downmix signal M into which the audio signal L and R is downmixed by, for example, calculating an average of the spectrally represented audio signal with two channels of left L and right R, in other words, by applying M=(L+R)/2.

The binaural cue extracting unit 12 generates BC information (binaural cue) for recovering the original audio signals L and R from the downmix signal M, by comparing the audio signals L and R and the downmix signal M on a spectral band-by-spectral band basis.

The BC information includes level information IID which indicates inter-channel level/intensity difference, correlation information ICC which indicates inter-channel coherence/correlation, and phase information IPD which indicates inter-channel phase/delay difference.

Here, the correlation information ICC indicates similarity of the audio signals L and R. Meanwhile, the level information IID indicates relative intensity of the audio signals L and R. In general, the level information IID is information for controlling balance and localization of a sound, and the correlation information ICC is information for controlling width and diffusiveness of the sound image. Both of these are spatial parameters for helping a listener mentally compose an auditory scene.

In a latest special codec, the spectrally represented audio signals L and R and the downmix signal M are usually divided into plural groups of "parameter bands." Thus, the BC information is computed on each parameter band-by-parameter band basis. Note that the terms "BC information (binaural cue)" and "spatial parameter" are often used synonymously and interchangeably.

The encoder 13 performs compression coding on the downmix signal M, using, for example, the MPEG Audio Layer-3 (MP3) and the Advanced Audio Coding (AAC). In other words, the encoder 13 encodes the downmix signal M to generate a compressed coded stream.

In addition to performing quantization on the BC information, the multiplexing unit 14 generates a bit stream by multiplexing the compressed downmix signal M and the quantized BC information, and outputs the bit stream as the coded signal.

The audio decoder 20 includes a demultiplexing unit 21, a decoder 22, and a multi-channel synthesizing unit 23.

The demultiplexing unit 21: obtains the bit stream; separates the bit stream into the quantized BC information and the encoded downmix signal M; and outputs the BC information and downmix signal M. Note that the demultiplexing unit 21 performs inverse quantization on the quantized BC information and output the inversely-quantized BC information.

The decoder 22 decodes the coded downmix signal M, and outputs the downmix signal M to the multi-channel synthesizing unit 23.

The multi-channel synthesizing unit 23 obtains the downmix signal M which is outputted from the decoder 22 and the BC information which is outputted from the demultiplexing unit 21. Then, the multi-channel synthesizing unit 23 recovers the audio signals L and R from the downmix signal M using the BC information. These processes for recovering the original two signals from the downmix signal involve a later-described "channel separation technique."

Note that the above example only describes how two signals can be represented as one downmix signal and a set of spatial parameters in an encoder, and how a downmix signal can be separated into two signals in a decoder by processing the downmix signal and the spatial parameters. With the technology, 2 or more channels of audio (for example, 6 channels from a 5.1 audio source) can be compressed into 1 or 2 downmix channels in a coding process and recovered in a decoding process.

In other words, the audio apparatus 1 is described in the above, exemplifying the fact that that the 2-channel audio signal is coded and decoded; meanwhile, the audio apparatus 1 can also code and decode a signal with 2 or more channels (for example, a 6-channel audio signal which composes a 5.1-channel audio source).

FIG. 2 is a block diagram showing a functional structure of the multi-channel synthesizing unit 23 in the case of the 6 channels.

In the case where the downmix signal M is separated into the 6-channel audio signals, for example, the multi-channel synthesizing unit 23 includes a first channel separating unit 241, a second channel separating unit 242, a third channel separating unit 243, a fourth channel separating unit 244, and a fifth channel separating unit 245. Note that a center audio signal C with respect to a speaker placed in front of a listener, a left-front audio signal Lf with respect to a speaker placed ahead of the listener on the left, a right-front audio signal Rf with respect to a speaker placed ahead of the listener on the right, a left-back audio signal Ls with respect to a speaker placed behind the listener on the left, a right-back audio signal Rs with respect to a speaker placed behind the listener on the right, and a low-frequency audio signal LFE with respect to a subwoofer speaker for bass output are downmixed to form the downmix signal M.

The first channel separating unit 241 separates the downmix signal M into an intermediate first downmix signal M1 and an intermediate fourth downmix signal M4 and outputs the first downmix signal M1 and the intermediate fourth down mix signal M4. The center audio signal C, the left-front audio signal Lf, the right-front audio signal Rf, and the low-frequency audio signal LFE are downmixed to form the first downmix signal M1. The left-back audiosignal Ls and the right-back audio signal Rs are downmixed to form the fourth downmix signal M4.

The second channel separating unit 242 separates the first downmix signal M1 into an intermediate second downmix signal M2 and an intermediate third downmix signal M3 and outputs the intermediate second downmix signal M2 and the intermediate third downmix signal M3. The left-front audio signal Lf and the right-front audio signal Rf are downmixed to form the second downmix signal M2. The center audio signal C and the low-frequency audio signal LFE are downmixed to form the third downmix signal M3.

The third cannel separating unit 243 separates the second downmix signal M2 into the left-front audio signal Lf and the right-front audio signal Rf and outputs the left-front audio signal Lf and the right-front audio signal Rf.

The fourth channel separating unit 244 separates the third downmix signal M3 into the center audio signal C and the low-frequency audio signal LFE and outputs the center audio signal C and the low-frequency audio signal LFE.

The fifth channel separating unit 245 separates the fourth downmix signal M4 into the left-back audio signal Ls and the right-back audio signal Rs and outputs the left-back audio signal Ls and the right-back audio signal R.

As described above, the multi-channel synthesizing unit 23 performs identical separation processing, in each channel separation unit, in which a single downmix signal is separated into two downmix signals using a multistage manner, then recursively repeats the separation of signals one-by-one until the signals are separated into signals each having a single channel.

FIG. 3 is another functional block diagram showing a functional structure for describing a principle of the multi-channel synthesizing unit 23.

The multi-channel synthesizing unit 23 includes an all-pass filter 261, a BCC processing unit 262, and a calculating unit 263.

The all-pass filter 261 obtains the downmix signal M, and generates and outputs a decorrelated signal Mrev which has no correlation to the downmix signal M. The downmix signal M and the decorrelated signal Mrev are considered to be "mutually incoherent" when auditorily compared with each other. The decorrelated signal Merv also has the same energy as the downmix signal M has, and thus includes reverberating components of a finite duration which create an illusion as if a sound was surrounded.

The BCC processing unit 262 obtains the BC information, and generates to output a mixing factor Hij for maintaining a degree of correlation between L and R and orientation of L and R based on the level information IID and the correlation information ICC included in the BC information.

The calculating unit 263: obtains the downmix signal M, the decorrelated signal Mrev, and the mixing factor Hij; performs calculation shown in an Expression (1) below, using these; and outputs the audio signals L and R. As described above, by using the mixing factor Hji, the degree of correlation between the audio signals L and R and the directionality of the signals can be set to an intended condition.

[Expression 1]

$$L=H_{11}*M+H_{12}*M_{rev}$$

$$R=H_{21}*M+H_{22}*M_{rev} \quad (1)$$

FIG. 4 is a block diagram showing a detailed structure of the multi-channel synthesizing unit 23. Note that the decoder 22 is illustrated, as well.

The decoder 22 decodes a coded downmix signal into the downmix signal M in a time domain, and outputs the decoded downmix signal M to the multi-channel synthesizing unit 23. The multi-channel synthesizing unit 23 includes an analysis filter bank 231, a channel expanding unit 232, and a temporal processing apparatus (energy shaping apparatus) 900. The channel expanding unit 232 includes a pre-matrix processing unit 2321, a post-matrix processing unit 2322, a first calculating unit 2323, a decorrelation processing unit 2324, and a second calculating unit 2325.

The analysis filter bank 231 obtains the downmix signal M which is outputted from the decoder 22, transforms an representation form of the downmix signal M into a time-frequency hybrid representation, and outputs as first frequency band signals x represented in a summarized vector x. Note that the analysis filter bank 231 includes a first stage and a second stage. For example, the first stage is a QMF filter bank and the second stage is a Nyquist filter bank. At these stages, the spectral resolution of a low frequency sub-band is enhanced by, first, dividing a frequency band into plural frequency bands, using the QMF filter (first stage), and further, dividing the sub-band on the low frequency side into finer sub-bands, using the Nyquist filter (second stage).

The pre-matrix processing unit 2321 in the channel expanding unit 232 generates a matrix R1; namely, a scaling factor showing allocation (scaling) of a signal intensity level to each channel, using the BC information.

For example, the pre-matrix processing unit 2321 generates the matrix R1, using the level information IID which shows ratios between a signal intensity level of the downmix signal M and each of the signal intensity levels of the first downmix signal M1, the second downmix signal M2, the third downmix signal M3, and the fourth downmix signal M4.

In other words, the pre-matrix processing unit 2321 computes a scaling factor which is a vector R1 including vector elements R1 [0] through R1 [4] of the ILD spatial parameter out of the synthetic signals M1 through M4, using an ILD spatial parameter for scaling an energy level of the input downmix signal M in order to generate intermediate signals which the first through the fifth channel separating units 241 to 245 shown in FIG. 2 can use to generate the decorrelated signals.

The first calculating unit 2323 obtains the first frequency band signal x, in the time-frequency hybrid expression, which are outputted from the analysis filter bank 231, and, as shown in an Expression (2) and an Expression (3) described below, computes a product of the first frequency band signal x and the matrix R1. Then, the first calculating unit 2323 outputs an intermediate signal v which shows the result of the matrix calculation.

[Expression 2]

$$v = \begin{bmatrix} M \\ M_1 \\ M_2 \\ M_3 \\ M_4 \end{bmatrix} = R_1 x \tag{2}$$

Here, M1 through M4 are shown in the following expressions (3).

[Expression 3]

$$M_1 = L_f + R_f + C + LFE$$

$$M_2 = L_f + R_f$$

$$M_3 = C + LFE$$

$$M_4 = L_s + R_s \tag{3}$$

The decorrelation processing unit 2324 has a function as the all-pass filter 261 shown in FIG. 3, generates and outputs decorrelated signal w by applying all-pass filter processing to the intermediate signal v, as shown in an Expression (4) below. Note that structural elements of the decorrelated signals w, Mrev, Mi, and rev are signals that decorrelation processing is performed on the downmix signals M and Mi.

[Expression 4]

$$w = \begin{bmatrix} M \\ decorr(v) \end{bmatrix} = \begin{bmatrix} M \\ M_{rev} \\ M_{1,rev} \\ M_{2,rev} \\ M_{3,rev} \\ M_{4,rev} \end{bmatrix} = \begin{bmatrix} M \\ 0 \\ 0 \\ 0 \\ 0 \\ 0 \end{bmatrix} + \begin{bmatrix} 0 \\ M_{rev} \\ M_{1,rev} \\ M_{2,rev} \\ M_{3,rev} \\ M_{4,rev} \end{bmatrix} = w_{Dry} + w_{Wet} \tag{4}$$

Note that wDry of the above Expression (4) is formed with an original downmix signal (referred to also as "dry" signal, hereinafter), and w-Wet is formed with a group of decorrelated signals (referred to also as "wet" signal, hereinafter).

The post-matrix processing unit 2322 generates a matrix R2, which shows distribution of reverberation to each channel, using the BC information. In other words, the post-matrix processing unit 2322 computes a mixing factor which is the matrix R2 for mixing M, Mi, and rev, in order to derive each signal. For example, the post-matrix 2322 drives the mixing factor Hij from the correlation information ICC which shows the width and diffusiveness of the sound image, and generates the matrix R2 which is formed from the mixing factor Hij.

The second calculating unit 2325 computes a product of the decorrelated signals w and the matrix R2, and outputs output signals y which shows the result of the matrix calculation. In other words, the second calculation unit 2325 separates the decorrelated signals w into six audio signals Lf, Rf, Ls, Rs, C, and LFE.

For example, as shown in FIG. 2, the left-front audio signal Lf is separated from the second downmix signal M2, thus for the separation of the left-front audio signal Lf, the second downmix signal M2 and the corresponding structural element of the decorrelated signals w, M2, rev, are used. Likewise, the second downmix signal M2 is separated from the first downmix signal M1, thus for computation of the second downmix signal M2, the first downmix signal M1 and the corresponding structure element of the decorrelated signals w, M1, rev, are used.

Thus, the left-front audio signal Lf is described in the expressions (5) below.

[Expression 5]

$$L_f = H_{11,A} * M_2 + H_{12,A} * M_{2,rev}$$

$$M_2 = H_{11,D} * M_1 + H_{12,D} * M_{1,rev}$$

$$M_1 = H_{11,E} * M + H_{12,E} * M_{rev} \tag{5}$$

Here, Hij, A in the expressions (5) are mixing factors at the third channel separating unit 243, Hij, D are mixing factors at the first channel separation unit 241. The three expressions described in the expressions (5) can be compiled into one multiplication expression described in the following Expression (6).

[Expression 6]

$$L_f = \begin{bmatrix} H_{11,A} H_{11,D} H_{11,E} & H_{11,A} H_{11,D} H_{12,E} \\ H_{11,A} H_{12,D} & H_{12,A} \quad 0 \quad 0 \end{bmatrix} w = R_{2,Lf} w \tag{6}$$

Other audio signals than the left-front audio signal Lf; namely, Rf, C, LFE, Ls, and Rs, are computed by a calculation of the above mentioned matrix and the matrix of the decorrelated signal w.

In other words, the output signal y are described in an Expression (7) described below.

[Expression 7]

$$y = \begin{bmatrix} Lf \\ Rf \\ Ls \\ Rs \\ C \\ LFE \end{bmatrix} = \begin{bmatrix} R_{2,Lf} \\ R_{2,Rf} \\ R_{2,Ls} \\ R_{2,Rs} \\ R_{2,C} \\ R_{2,LFE} \end{bmatrix} w = R_2 w = R_2 w_{Dry} + R_2 w_{Wet} = y_{Dry} + y_{Wet} \tag{7}$$

R2, the matrix, is an assembly of multiples of the mixing factors from the first to fifth channel separating units 241 to 245, looks like linear-combination of M, Mrev, M2, rev, . . . M4, rev since multi-channel signals are generated. For the following energy shaping processing, the y-Dry and the y-Wet are stored separately.

The temporal processing apparatus 900 transforms the restored expression form of each audio signal from the time-frequency hybrid expression to a time expression, and outputs plural audio signals in the time expression as a multi-channel signal. Note that the temporal processing apparatus 900 includes, for example, two stages, so as to match with the analysis filter bank 231. Furthermore, the matrixes R1 and R2 are generated as matrixes R1(*b*) and R2(*b*) for each parameter band b described above.

Here, before a wet signal and a dry signal are merged, the wet signal is shaped according to a temporal envelope of the dry signal. This module, the temporal processing apparatus 900, is essential for signals having a high-speed time-varying characteristic, such as an attack sound.

In other words, in order to prevent sound from blunting in the case of a signal such as an attack sound and an audio signal which drastically changes in time, the temporal processing apparatus 900 maintains the original sound quality by adding, a signal in which the time envelop of diffuse signals are shaped and direct signals so as to match the time envelop of the direct signals, and outputting the added signal.

FIG. 5 is a block diagram showing a detailed structure of the temporal processing apparatus 900 shown in FIG. 4.

As shown in FIG. 5, the temporal processing apparatus 900 includes a splitter 901, synthesis filter banks 902 and 903, a downmix unit 904, bandpath filters (BPF) 905 and 906, normalization processing units 907 and 908, a scale computation processing unit 909, a smoothing processing unit 910, a calculating unit 911, high-pass filters 912 and 913, and an adding unit 913.

The splitter 901 splits a recovered signal y into direct signals y-direct and diffuse signals y-diffuse as shown in the following Expression (8) and Expression (9).

[Expression 8]

$$y_{direct} = \begin{bmatrix} y_{1,direct} \\ y_{2,direct} \\ y_{3,direct} \\ y_{4,direct} \\ y_{5,direct} \\ y_{6,direct} \end{bmatrix} = \begin{cases} y_{Dry} + y_{Wet} & \text{For low frequency region} \\ y_{Dry} & \text{For high frequency region} \end{cases} \tag{8}$$

[Expression 9]

$$y_{diffuse} = \begin{bmatrix} y_{1,diffuse} \\ y_{2,diffuse} \\ y_{3,diffuse} \\ y_{4,diffuse} \\ y_{5,diffuse} \\ y_{6,diffuse} \end{bmatrix} = \begin{cases} 0 & \text{For low frequency region} \\ y_{Wet} & \text{For high frequency region} \end{cases} \tag{9}$$

The synthesis filter bank 902 transforms the six direct signals into the time domain. The synthesis filter bank 903 transforms the six diffuse signals into the time domain, as well as the synthesis filter bank 902.

The downmix unit 904 adds up the six direct signals in the time domain to form one direct downmix signal M-direct, based on an Expression (10) below.

[Expression 10]

$$M_{direct} = \sum_{i=1}^{6} y_{i,direct} \tag{10}$$

The BPF 905 performs bandpass processing on one direct downmix signal. As well as the BPF 905, the BPF 906 performs bandpass processing on all of the six diffuse signals. The bandpassed direct downmix signal and the diffuse signals are shown in an Expression (11) below.

[Expression 11]

$$M_{direct,BP} = \text{Bandpass}(M_{direct})$$

$$y_{i,diffuse,BP} = \text{Bandpass}(y_{i,diffuse}) \tag{11}$$

The normalization processing unit 907 normalizes the direct downmix signal so that the direct downmix signal has one piece of energy for one processing frame, based on an Expression (12) shown below.

[Expression 12]

$$M_{direct,norm}(t) = \frac{M_{direct,BP}(t)}{\sqrt{\sum_t M_{direct,BP}(t) \cdot M_{direct,BP}(t)}} \tag{12}$$

As well as the normalization processing unit 907, the normalization processing unit 908 normalizes the six diffuse signals, based on an Expression (13) shown below.

[Expression 13]

$$\ldots \tag{13}$$

The normalized signals are divided into time blocks in the scale computation processing unit 909. Then, the scale computation processing unit 909 computes a scale factor for each time block, based on an Expression (14) shown below.

[Expression 14]

$$scale_i(b) = \sqrt{\frac{\sum^{t \subset b} M_{direct,norm}(t) \cdot M_{direct,norm}(t)}{\sum^{t \subset b} y_{i,diffuse,norm}(t) \cdot y_{1,diffuse,norm}(t)}} \tag{14}$$

Note that FIG. 6 is a drawing showing the above dividing processing in the case where a time block b in the above Expression (14) shows a "block index."

Finally, the diffuse signals are scaled in the calculating unit 911, and, in the HPF 912, highpass-filtered based on an Expression (15) below before combined with the direct signals in the is adding unit 913 as shown below.

[Expression 15]

$$y_{i,diffuse,scaled,HP} = \text{Highpass}(y_{i,diffuse} \cdot \text{scale}_i)$$

$$y_i = y_{i,direct} + y_{i,diffuse,scaled,HP} \tag{15}$$

Note that the smoothing processing unit 910 is an optional technique for improving smoothness of the scale factor which covers continuous time blocks. For example, the continuous time blocks may be overlapped with each other as shown in a in FIG. 6, and the "weighted" scale factor in the overlapped area is calculated, using a window function.

Also in a scaling processing 911, a person skilled in the art can use such a conventionally known overlapping and adding technique.

As mentioned above, the conventional temporal processing apparatus 900 presents the above energy shaping method by shaping each decorrelated signal in the time domain for each of the original signals.

Non-patent Reference 1:J. Herre, et al, "The Reference Model Architecture for MPEG Spatial Audio Coding", 118$^{th}$ AES Convention, Barcelona.

DISCLOSURE OF INVENTION

Problems that Invention is to Solve

However, the conventional energy shaping apparatus requires synthetic filter processing on the twelve signals, half of is which are direct signals and the remaining half of which are diffuse signals, thus the calculation load is very heavy. In addition, the use of various kinds of frequency bands and a high-pass filter causes delay in filter processing.

In other words, the conventional energy shaping apparatus transforms the respective direct signals and diffuse signals which have been split by the splitter 901 into signals in the time domain by the synthesis filter banks 902 and 903. Thus, in the case where the input audio signals have 6 channels, the number of synthesis filters to be required for each time frame is 12 obtained by multiplexing 6 with 2, which causes a problem of requiring a very large processing amount.

Furthermore, since bandpass processing and high-frequency-passing processing are performed on the direct signals and the diffuse signals, in the time domain, which have been transformed by the synthesis filter banks 902 and 903, there is also a problem that a delay caused for the passing processing occurs.

Thus, the object of the present invention is solving the above problems, and providing an energy shaping apparatus and an energy shaping method which can reduce the processing amount of the synthesis filter processing and preventing the occurrence of a delay caused for the passing processing.

Means to Solve the Problems

In order to achieve the above objectives, an energy shaping apparatus in the present invention performs energy shaping in decoding of a multi-channel audio signal, and includes: a splitting unit which splits an audio signal in a sub-band domain into diffuse signals indicating a reverberating component and direct signals indicating a non-reverberating component, the audio signal which is obtained by performing a hybrid time-frequency transformation; a downmix unit which generates a downmix signal by downmixing the direct signals; a filter processing unit which generates a bandpass downmix signal and bandpass diffuse signals by bandpassing the downmix signal and the diffuse signals per sub-band, the diffuse signals which are split on the sub-band basis; a normalization processing unit which generates a normalized downmix signal and normalized diffuse signals, respectively, by normalizing the bandpass downmix signal and the bandpass diffuse signals with regard to respective energy; a scale factor computing unit which computes, for each of predetermined time slots, a scale factor indicating magnitude of energy of the normalized downmix signal with respect to the energy of the normalized diffuse signals; a multiplying unit which generates scale diffuse signals by multiplying each of the diffuse signals by a corresponding one of the scale factors; a high-pass processing unit which generates high-pass diffuse signals by highpassing the scale diffuse signals; an adding unit which generates addition signals by adding the high-pass diffuse signals and the direct signals; and a synthesis filter processing unit which applies synthesis filtering to the addition signals and transform the addition signals into time domain signals.

As mentioned above before the synthesis filtering, the direct signal and the diffuse signal in each channel are bandpassed on the sub-band basis. Thus, bandpass processing can be achieved by simple multiplication, and delay caused by the bandpass processing can be prevented. Furthermore, the synthesis filtering for transforming the addition signals to the time domain signals is applied to the addition signals after the direct signal and the diffuse signal in each channel are processed. Thus, for example, in the case where there are six channels, the number of the synthesis filter processing can be reduced to six; therefore, processing amount of synthesis filter processing can be reduced to a half as little as that of the conventional processing.

Furthermore, the energy shaping apparatus of the present invention includes a smoothing unit which generates a smoothed scale factor by smoothing the scale factor so as to suppress a fluctuation on the time slot basis.

By doing so, a problem, such as a drastic change and over flow of the value of the scale factor calculated in a frequency domain, thus resulting in an occurrence of sound quality degradation, can be prevented.

Moreover, in the energy shaping apparatus of the present invention, the smoothing unit performs the smoothing processing by adding: a value which is obtained by multiplying a scale factor in a current time slot by $\alpha$; and a value which is obtained by multiplying a scale factor in an immediately preceding time slot by $(1-\alpha)$.

By doing so, the drastic change and the overflow of the value of the scale factor calculated in the frequency domain can be prevented with simple processing.

In addition, the energy shaping apparatus of the present invention includes a clip processing unit which performs clip processing on the scale factor by limiting the scale factor to one of: an upper limit when the scale factor exceeds a predetermined upper limit; and a lower limit when the scale factor falls below a predetermined lower limit.

By doing the above as well, the problem, such as the drastic change and over flow of the value of the scale factor calculated in the frequency domain, thus resulting in the occurrence of sound quality degradation, can be prevented.

Furthermore, in the energy shaping apparatus of the present invention, the clip processing unit sets, when the upper limit is set to $\beta$, the lower limit to $1/\beta$ and performs the clip processing.

By doing this as well, the drastic change and the over flow of the value of the scale factor calculated in the frequency domain can be prevented with simple processing.

Moreover, in the energy shaping apparatus of the present invention, the direct signals include a reverberating component and a non-reverberating component in a low frequency band of the audio signal, and an other non-reverberating component in a high frequency band of the audio signal.

In addition, in the energy shaping apparatus of the present invention, the diffuse signals include the reverberating component in a high frequency band of the audio signal, and do not include a low frequency component of the audio signal.

Furthermore, the energy shaping apparatus of the present invention includes a control unit which selectively enables or disables energy shaping to be performed on the audio signal. Thus both sharpness of temporal variation of a sound and solid localization of a sound image can be achieved by selectively enabling or disabling energy shaping to be performed.

Moreover, in the energy shaping apparatus of the present invention, the control unit may select one of the diffuse signals and the high-pass diffuse signals in accordance with control flags, and the adding unit may add the signals selected at the control unit and direct signals.

According to the above, the control unit selectively enables or disables, moment by moment, energy shaping to be performed with ease.

Note that the present invention can be implemented not only as the energy shaping apparatus mentioned above, but also as: an energy shaping method including characteristic units in the energy shaping apparatus as steps; a program causing a computer to execute those steps; and an integrated circuit including the characteristic units in the energy shaping apparatus. As a matter of course, such a program can be distributed via a transmission medium such as a recording medium, like a CD-ROM, and the Internet.

Effects of the Invention

As described above, an energy shaping apparatus of the present invention, without modifying bit stream syntax and maintaining high sound quality, can lower the processing amount of synthesis filtering and prevent the occurrence of delay caused by passing processing.

Thus, thanks to the present invention, distribution of music contents to cellular phones and handheld terminals and listening the music contents thereon have become popular, thus today, the present invention is of significant practical value.

NUMERICAL REFERENCES

Figure 1:
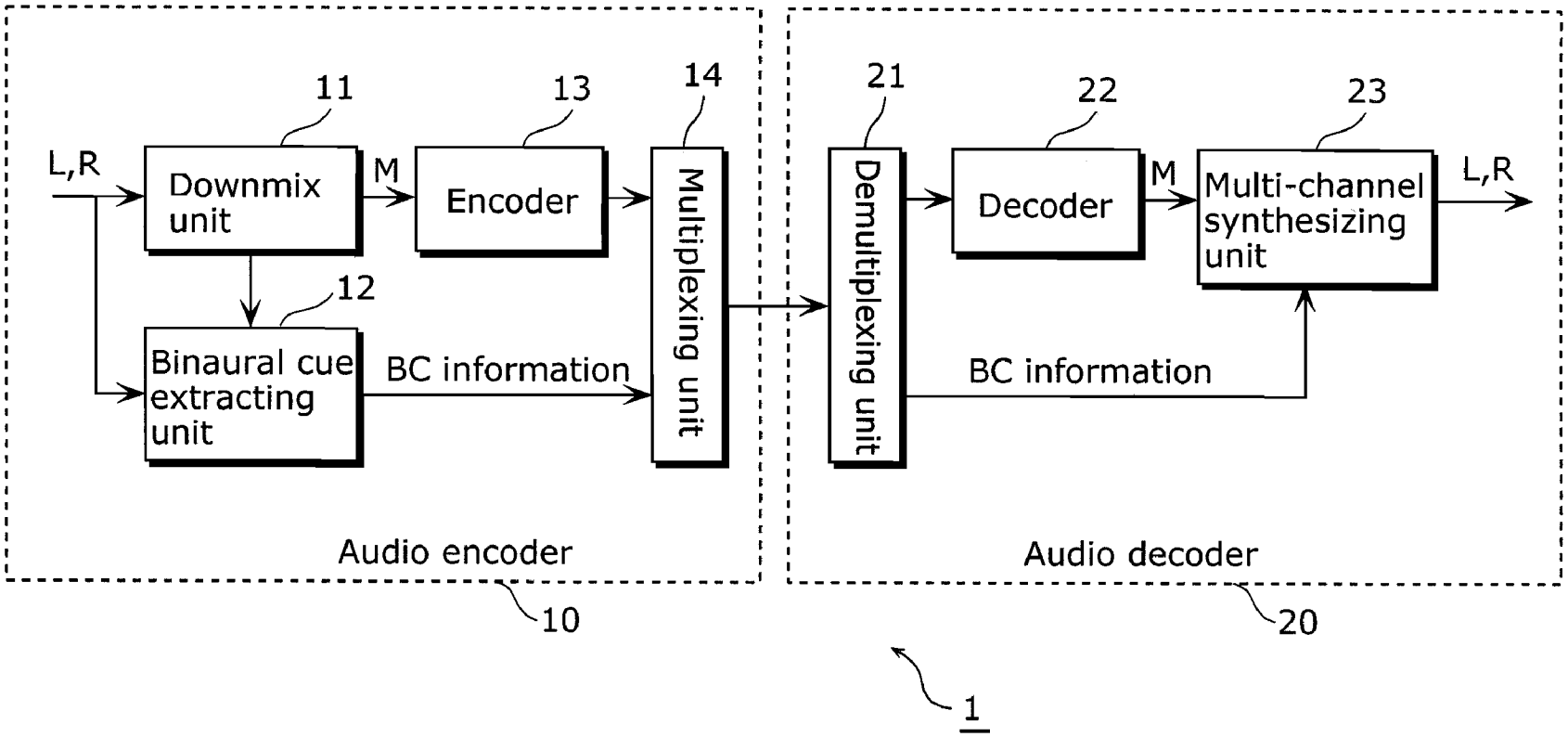
FIG. 1 is a block diagram showing an overall structure of an audio apparatus utilizing a basic principle of spatial coding.
Figure 2:
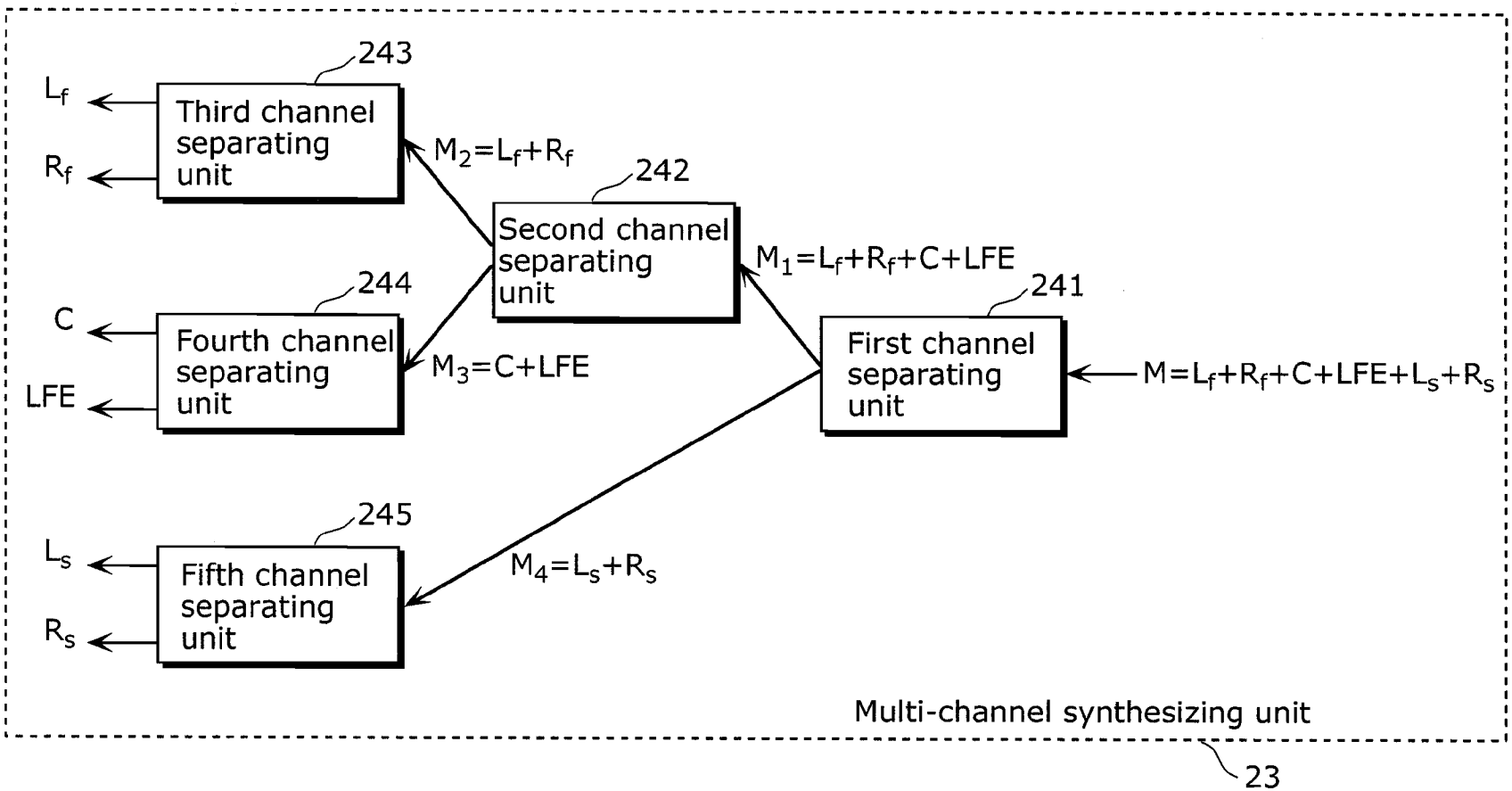
FIG. 2 is a block diagram showing a functional structure of a multi-channel synthesizing unit 23 in the case of a six-channel signal.
Figure 3:
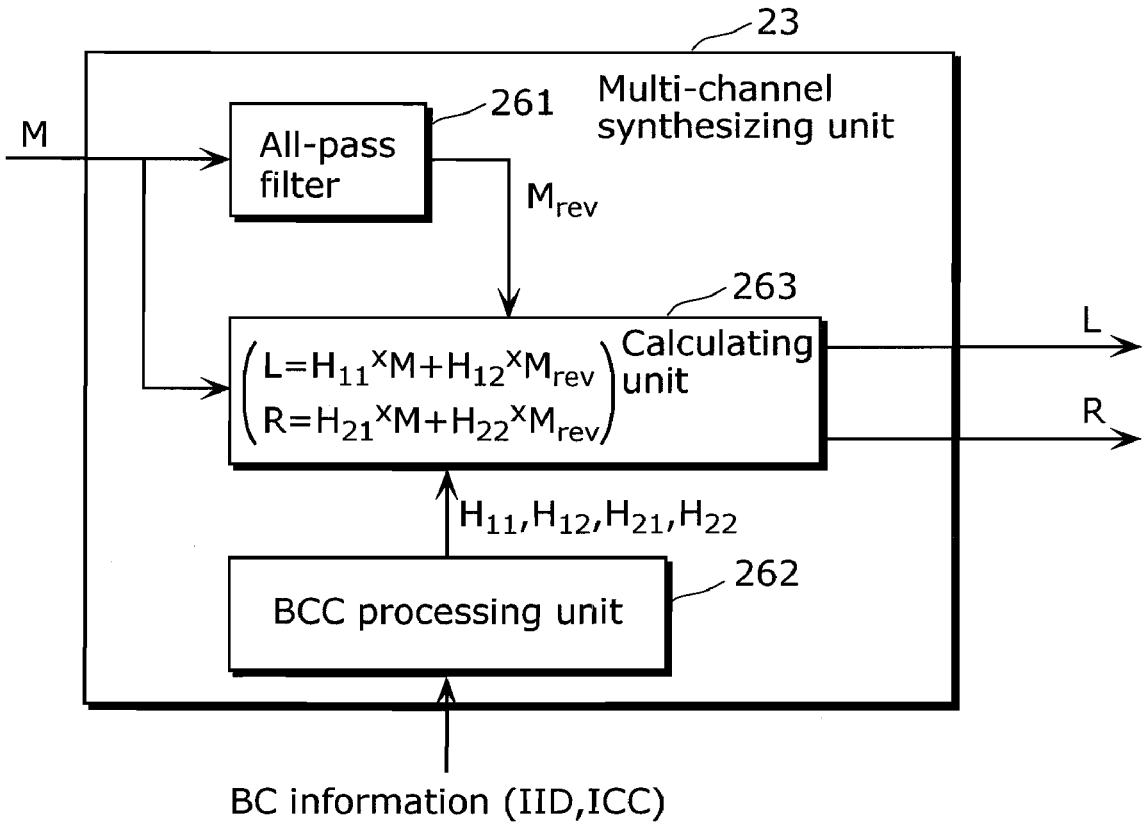
FIG. 3 is another functional block diagram showing a functional structure for describing a principle of the multi-channel synthesizing unit 23.
Figure 4:
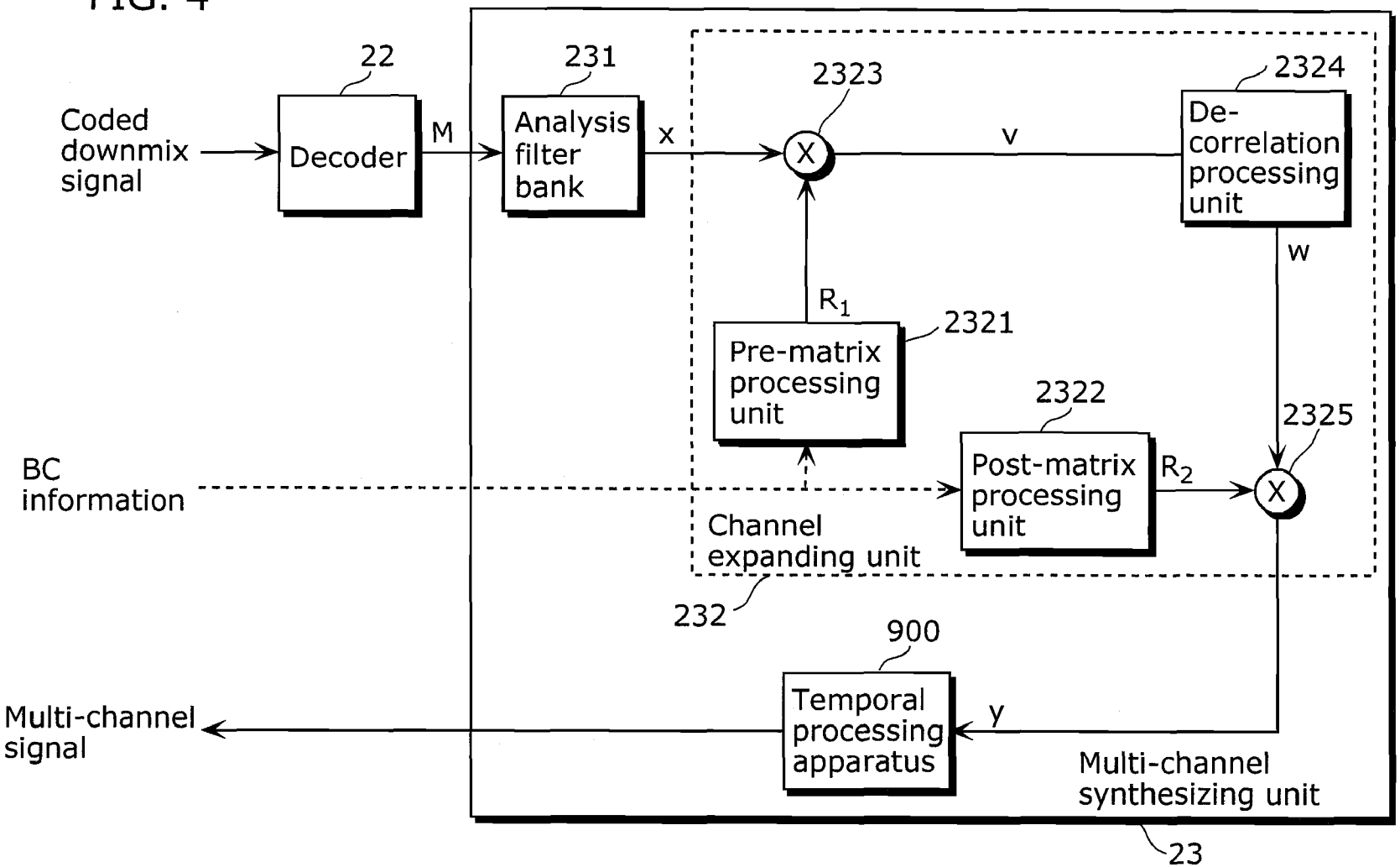
FIG. 4 is a block diagram showing a detailed structure of the multi-channel synthesizing unit 23.

600*a*, 600*b* Temporal processing apparatus
601 Splitter
604 Downmix unit
605, 606 BPF
607, 608 Normalization processing unit
609 Scale computation processing unit
610 Smoothing processing unit
611 Calculating unit
612 HPF
613 Adding unit
614 Synthesis filter bank
615 Control unit

BEST MODE FOR CARRYING OUT THE INVENTION

Embodiments of the present invention will be described in detail below, using the drawings. Note that the embodiments described below merely explain principles of various inventive steps. A person skilled in the art would clearly understand that the Embodiments can be modified into Variations described here. Thus, the present invention is limited only by the scope of the patent claims, and not by the following specific and illustrative details.

First Embodiment

Figure 7:
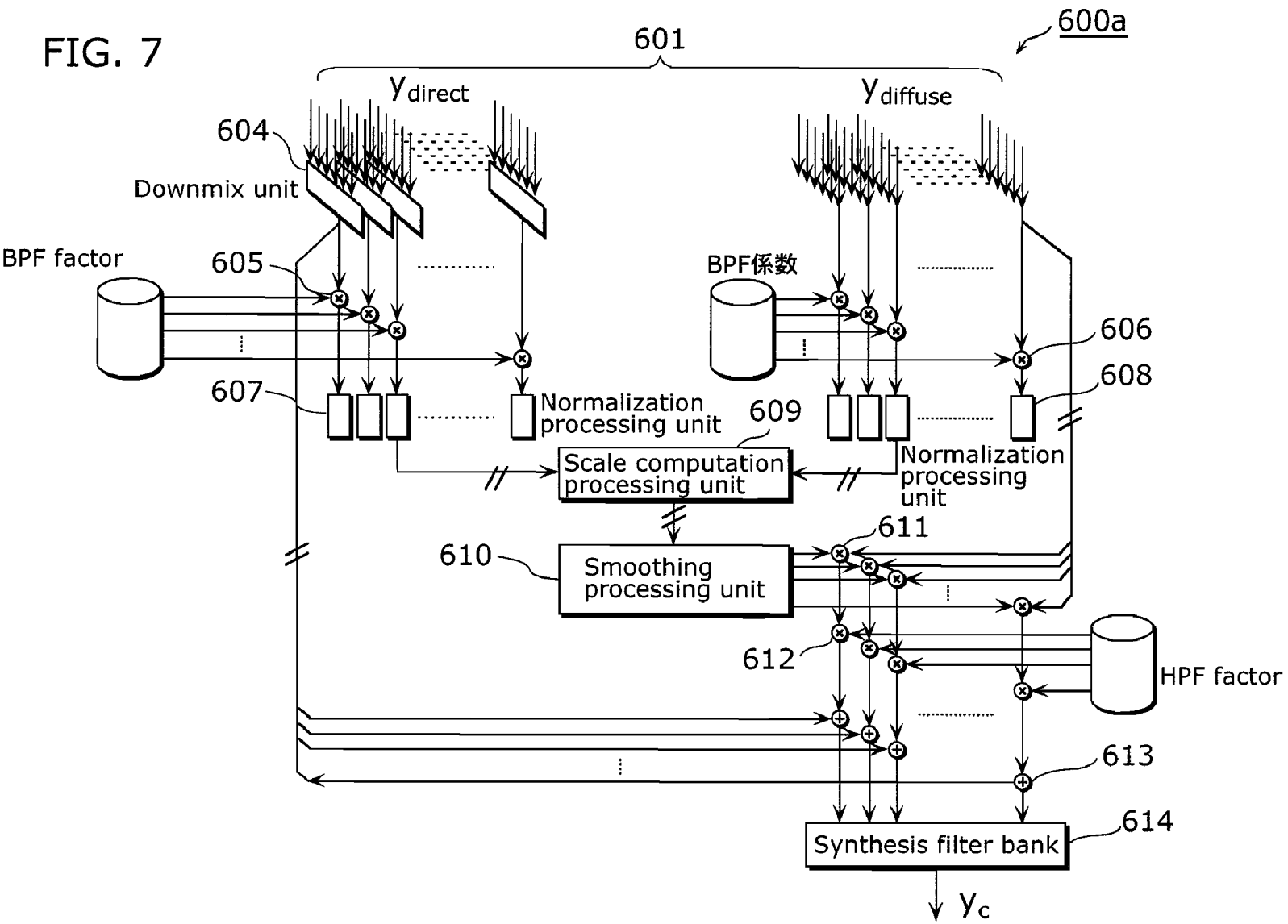
FIG. 7 is a drawing showing a structure of a temporal processing apparatus (energy shaping apparatus) in a first embodiment of the present invention.

FIG. 7 is a drawing showing a structure of a temporal processing apparatus (energy shaping apparatus) in a first embodiment of the present invention.

Figure 5:
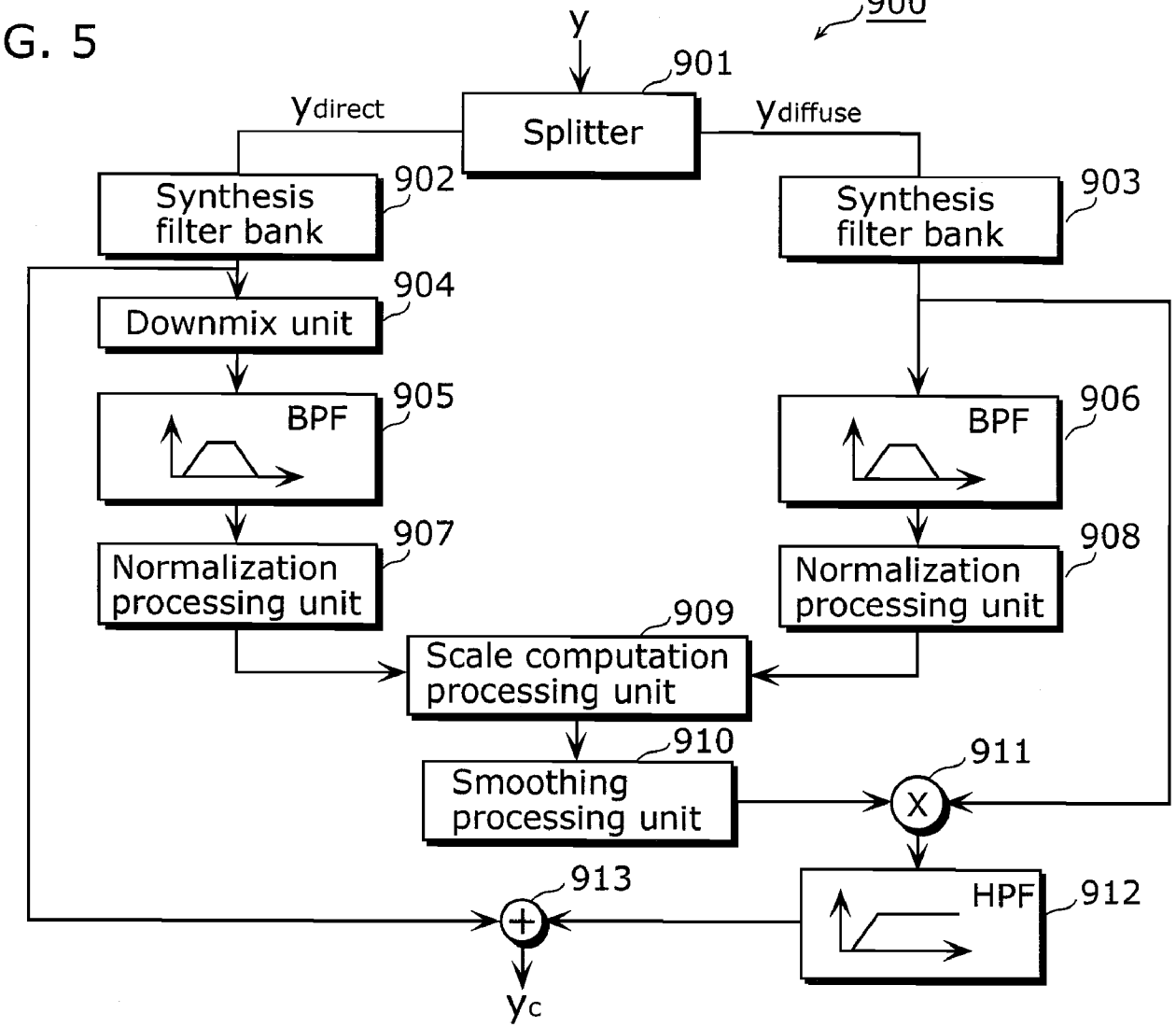
FIG. 5 is a block diagram showing a detailed structure of a temporal processing apparatus 900 shown in FIG. 4.
Figure 6:
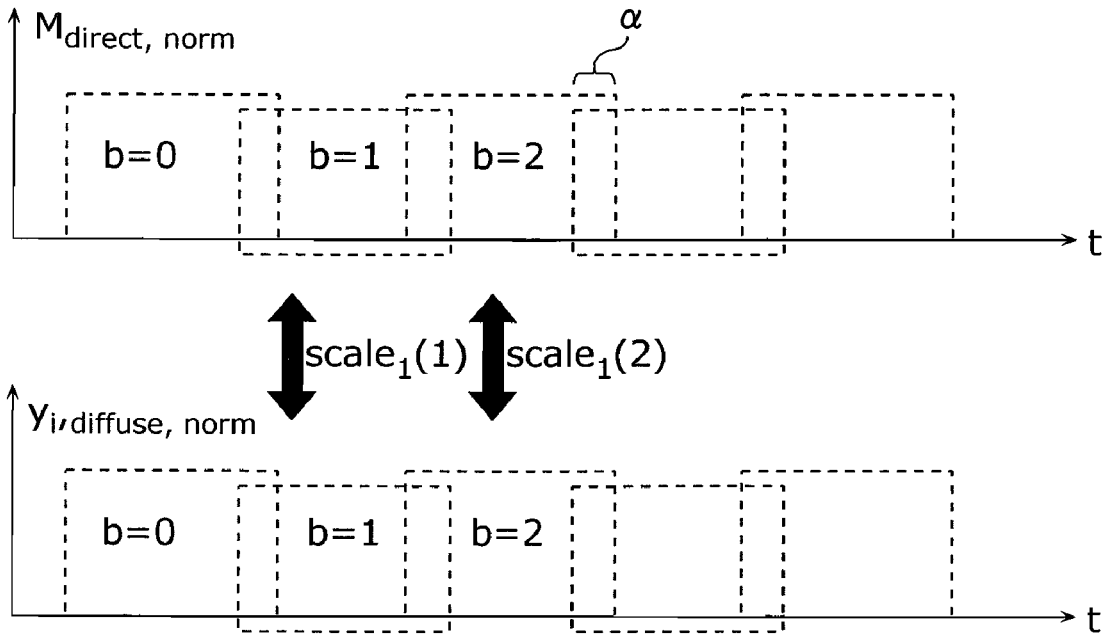
FIG. 6 is a drawing showing a smoothing technique based on overlap windowing processing in a conventional shaping method.

Taking the place of a temporal processing apparatus 900 in FIG. 5, this temporal processing apparatus 600*a* is an apparatus which includes a multi-channel synthesizing unit 23, and includes, as shown in FIG. 7, a splitter 601, a downmix unit 604, a BPF 605, a BPF 606, a normalization processing unit 607, a normalization processing unit 608, a scale computation processing unit 609, a smoothing processing unit 610, a calculation unit 611, an HPF 612, an adding unit 613, and a synthesis filter bank 614.

The temporal processing apparatus 600*a* is structured to reduce, by 50 percent, synthesis filter processing load which has been conventionally required, and furthermore to be capable of simplifying processing in each unit by: directly receiving output signals, which are expressed in hybrid time and frequency, which are included in a sub-band domain from a channel expanding unit 232; and then by inversely transforming the output signals to time signals in the end, using a synthesis filter.

Operations of the splitter 601 are the same as those of the splitter 901 in FIG. 5, and the description is omitted. In other words, the splitter 601 splits an audio signal, included in the sub-band domain, which are obtained by performing a hybrid time and frequency transformation into diffuse signals indicating reverberating components and direct signals indicating non-reverberating components.

Here, the direct signals include, reverberating components and non-reverberating components in the low frequency band of the audio signal, and other non-reverberating components in the high frequency band of the audio signal. Here, the diffuse signals include, the reverberating components in the high frequency band of the audio signal, but do not include low frequency components of the audio signal. For this reason, it is possible to apply an appropriate prevention of a sound such as an attach sound which drastically changes in time from blunting.

The downmix unit 604 in the present invention differs from the downmix unit 904 described in Non-patent Reference 1 as to whether time domain signals or whether sub-band domain signals are to be processed. However, both of these use a common general multi-channel downmix processing approach. In other words, the downmix unit 604 generates a downmix signal by downmixing the direct signals.

The BPF 605 and the BPF 606 respectively generate a bandpass downmix signal and bandpass diffuse signals by bandpassing the downmix signal and the diffuse signals per sub-band, the diffuse signals which are split on the sub-band basis.

Figure 8:
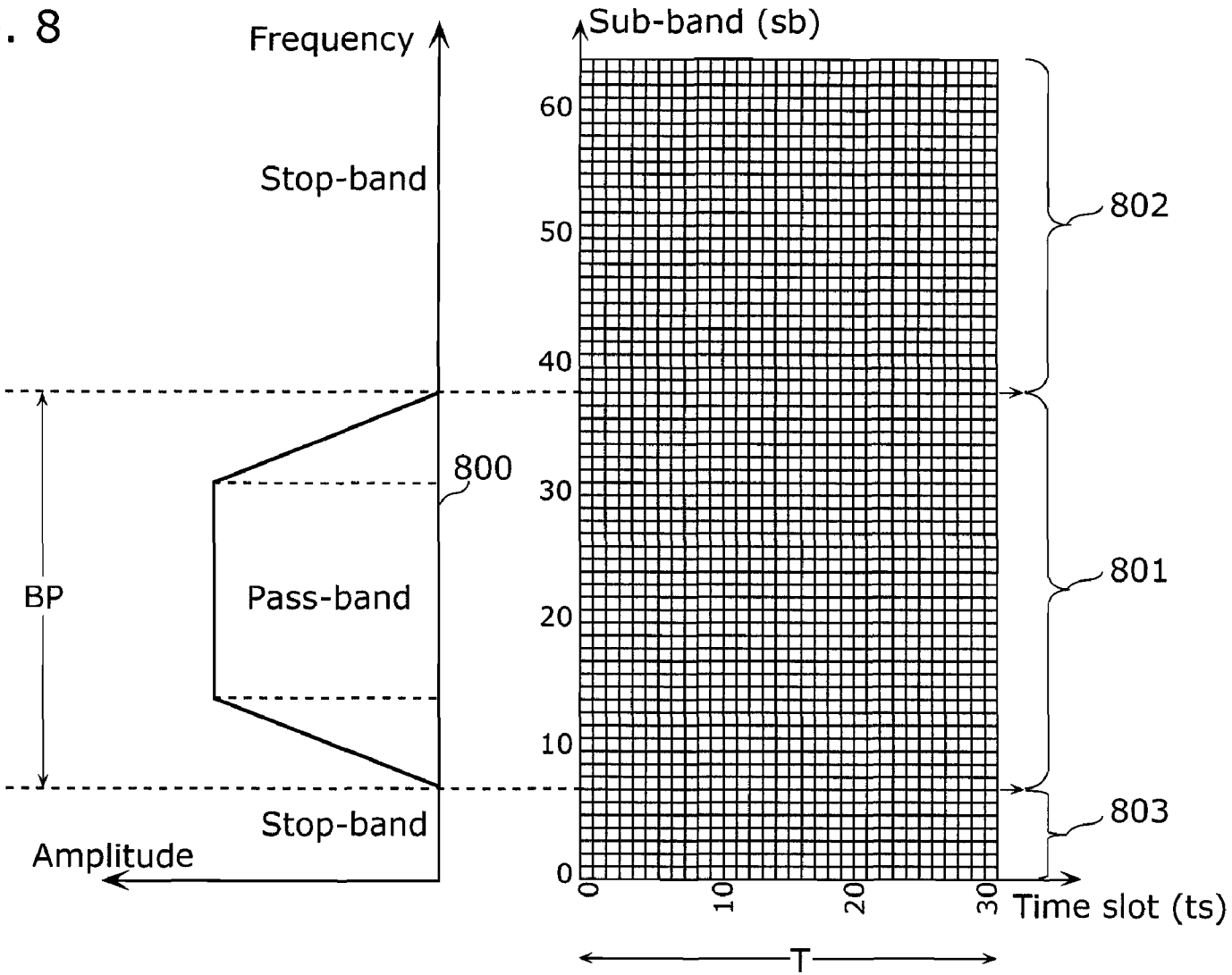
FIG. 8 is a drawing describing considerations for bandpass filtering in a sub-band domain and saving computation.

As shown in FIG. 8, bandpass filtering processing in the BPF 605 and the BPF 606 is simplified to simple multiplication of each sub-band with a corresponding frequency response of a bandpass filter. In a broad sense, the bandpass filter can be considered as a multiplier. Here, 800 indicates the frequency response of the bandpass filter. Furthermore, here, multiplication calculation may be performed only on a region 801 having an important bandpass response, thus, calculation amount can be further reduced. For example, a multiplication result is assumed to be 0 in outside stop-band regions 802 and 803. When a pass-band amplitude is 1, the multiplication can be considered as simple duplication.

In other words, the bandpass filtering processing in the BPF 605 and the BPF 606 is performed based on an Expression (16) below.

[Expression 16]

$$M_{direct,BP}(\mathrm{ts,sb})=M_{direct}(\mathrm{ts,sb})\cdot\mathrm{Bandpass(sb)}$$

$$y_{i,diffuse,BP}(\mathrm{ts,sb})=y_{i,diffuse}(\mathrm{ts,sb})\cdot\mathrm{Bandpass(sb)} \quad (16)$$

Here, ts is a time slot index and sb is a sub-band index. As explained above, a Bandpass (sp) may be a simple multiplier.

The normalization processing units 607 and 608 respectively generate a normalized downmix signal and normalized diffuse signals by normalizing the bandpass downmix signal and the bandpass diffuse signals with regard to respective energy.

The normalization processing unit 607 and the normalization processing unit 608 are different from the normalization processing unit 907 and the normalization processing unit 908 disclosed in Non-patent Reference 1 in the following points. With respect to a domain of signals to be processed, the normalization processing unit 607 and the normalization processing unit 608 process signals in the sub-band domain, and the normalization processing unit 907 and the normalization processing unit 908 process signals in a time domain. In addition, with the exception of using complex conjugates shown below, the normalization processing unit 607 and the normalization processing unit 608 follow a common normalization processing technique; that is, an Expression (17) below.

In this case, the normalization processing needs to be performed on a sub-band basis; however, thanks to an advantage of the normalization processing unit 607 and the normalization processing unit 608, computation can be omitted for a spatial region having data including a zero. Thus, compared with the normalization module, disclosed in the Reference where all samples to be subjected to normalization must be processed, very little increase in overall calculation load is observed.

[Expression 17]

$$M_{direct,norm}(ts,sb)=\frac{M_{direct,BP}(ts,sb)}{\sqrt{\sum^{ts\subset T}\sum^{sb\subset BP}M_{direct,BP}(ts,sb)\cdot M^{*}_{direct,BP}(ts,sb)}} \quad (17)$$

$$y_{i,diffuse,norm}(ts,sb)=\frac{y_{i,diffuse,BP}(ts,sb)}{\sqrt{\sum^{ts\subset T}\sum^{sb\subset BP}y_{i,diffuse,BP}(ts,sb)\cdot y^{*}_{i,diffuse,BP}(ts,sb)}}$$

The scale computation processing unit 609 computes, on a predetermined time slot basis, a scale factor indicating the magnitude of energy of the normalized downmix signal with respect to energy of the normalized diffuse signals. More specifically, as mentioned below, with the exception that calculation is performed on the time slot basis rather than the time block basis, the calculation by the scale computation processing unit 609 is also the same as the calculation performed by the scale computation processing unit 909 in principle, as shown in an Expression (18) below.

[Expression 18]

$$scale_i(ts)=\sqrt{\frac{\sum^{sb\subset BP}M_{direct,norm}(ts,sb)\cdot M^{*}_{direct,norm}(ts,sb)}{\sum^{sb\subset BP}y_{i,diffuse,norm}(ts,sb)\cdot y^{*}_{i,diffuse,norm}(ts,sb)}} \quad (18)$$

When far little data, in a time domain, to be processed is available, a smoothing technique based on overlap-window processing performed by the smoothing processing unit 910 must also be performed by the smoothing processing unit 610.

However, in the case of the smoothing processing unit 610 of the present invention, the smoothing processing is performed on a very small unit basis, thus with regard to the scale factor, when the idea of the scale factor described in the Reference (expression 14) is directly utilized, smoothing level may vary greatly. Therefore, the scale factor itself need to be smoothed.

For this reason, for example, a simple low-pass filter as shown in an Expression (19) below can be used in order to suppress the drastic fluctuation of scalei (ts) on the time slot basis.

[Expression 19]

$$\mathrm{scale}_i(\mathrm{ts})=\alpha\cdot\mathrm{scale}_i(\mathrm{ts})+(1-\alpha)\cdot\mathrm{scale}_i(\mathrm{ts}-1) \quad (19)$$

In other words, the smoothing processing unit 610 generates a smoothed scale factor by smoothing processing the scale factor so as to suppress the variation on the time slot basis. More specifically, the smoothing processing unit 610 performs the smoothing processing by adding: a value which is obtained by multiplying a scale factor in the current time slot by $\alpha$; and a value which is obtained by multiplying a scale factor in the immediately preceding time slot by $(1-\alpha)$.

Here, $\alpha$ is set to 0.45, for example. By changing the magnitude of $\alpha$, the effect of the smoothing processing can be controlled.

The value of the above $\alpha$ can be transmitted from an audio encoder 10 on an encoding apparatus side, and the smoothing processing can be controlled on a receiver side, thus a wide range of effects can be achieved. As a matter of course, as mentioned above, a predetermined value of $\alpha$ may be stored in the smoothing processing apparatus.

When signal energy processed with the smoothing processing is large, there is a possibility that the energy concentrates on a specific frequency band, and that an output of the smoothing processing overflows. In order to prepare for the case, for example, clip processing is performed on scalei (ts) as shown in an Expression (20) below.

[Expression 20]

$$\mathrm{scale}_i(\mathrm{ts})=\min(\max(\mathrm{scale}_i(\mathrm{ts}),1/\beta),\beta) \quad (20)$$

Here, $\beta$ is a clipping factor, and min ( ) and max ( ) show a minimum value and a maximum value respectively.

In other words, the clip processing unit (not shown) performs clip processing on the scale factor by limiting the scale factor to one of: an upper limit when the scale factor exceeds the predetermined upper limit; and a lower limit when the scale factor falls below the predetermined lower limit.

The Expression (20) describes the fact that when scalei (ts) calculated on a channel-by-channel basis is $\beta=2.82$, for example, the upper limit is set to 2.82, and the lower limit is set to 1/2.82, so that scalei (ts) is controlled to a value within the range. Note that the threshold values 2.82 and 1/2.82 are just an example, and not limited to the values.

The calculating unit 611 generates scale diffuse signals by multiplying each of the diffuse signals by the scale factor. The HPF 612 generates high-pass diffuse signals by highpassing the scale diffuse signals. The adding unit 613 generates addition signals by adding the high-pass diffuse signals and the direct signals.

Specifically, operations of the calculation unit 611, the HPF 612, and the adding unit 613 in which the direct signals are added are performed as the synthesis filter bank 902, the HPF 912, and the adding unit 913 perform respectively.

However, the above processing can be combined as shown in an Expression (21) below.

[Expression 21]

$$y_{i,diffuse,scaled,HP}(ts,sb)=y_{i,diffuse}(ts,sb)\cdot scale_i(ts)\cdot High\text{-}pass(sb)$$

$$y_i=y_{i,direct}+y_{i,diffuse,scaled,HP} \quad (21)$$

The consideration for reducing the amount of calculation performed in the BPF 605 and the BPF 606 (for example, applying zero to a stopband and duplication processing to a passband) can also be applied to the high-pass filter 612.

The synthesis filter bank 614 applying synthesis filtering to the addition signals and transforms the addition signals into the time domain signals. In other words, lastly, the synthesis filter bank 614 transforms a new direct signals yl into the time domain signals.

Note that each structure element included in the present invention may be configured with an integrated circuit, such as the Large Scale Integration (LSI).

Furthermore, the present invention can be implemented as a program to cause a computer to execute the operations in these apparatuses and each structure element.

Second Embodiment

Figure 9:
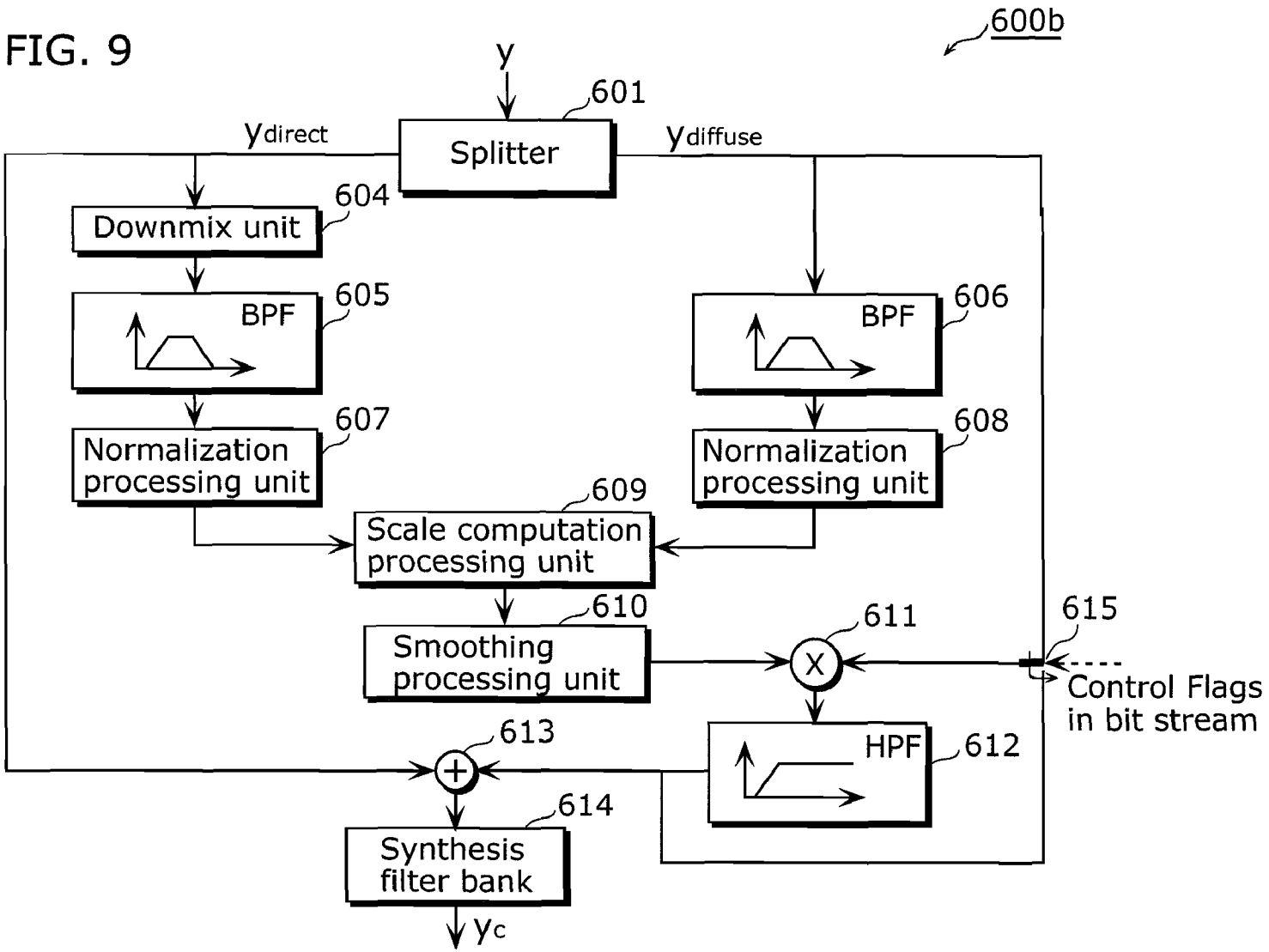
FIG. 9 is a drawing showing a structure of the temporal processing apparatus (energy shaping apparatus) in the first embodiment of the present invention.

Furthermore, a decision whether or not the present invention is applied can be made by: setting some control flags in a bit stream; and then, at a control unit 615 in a temporal processing apparatus 600*b* shown in FIG. 9, controlling, using the flags, the present invention to operate or not to operate on a basis of a frame of a partly-reconstructed signal. In other words, the control unit 615 may selectively enable or disable energy shaping to be performed on an audio signal on a time frame-by-time frame basis, or a channel-by-channel basis. Accordingly, both sharpness of temporal variation of a sound and solid localization of a sound image can be achieved by enabling or disabling energy shaping.

Thus, for example, in an encoding process, acoustic channels may be analyzed to determine whether or not the acoustic channels have an energy envelop with a great change. In the case where there is a relevant acoustic channel, the acoustic channel requires energy shaping; therefore, the control flags may be set to on, and, when decoding, the shaping processing may be applied in accordance with the control flags.

In other words, the control unit 615 may select one of diffuse signals and high-pass diffuse signals in accordance with the control flags, and an adding unit 613 may add the signals selected at the control unit 615 and direct signals. According to the above, the control unit 615 selectively enables or disables, moment by moment, energy shaping to be performed with ease.

Industrial Applicability

An energy shaping apparatus according to the present invention is a technique for reducing required memory capacity, so as to further downsize a chip and applicable to apparatuses for which multi-channel reproduction is desirable, such as home theater systems, car audio systems, electronic game systems, and cellular phones.

The invention claimed is:

1. An energy shaping apparatus which performs energy shaping in decoding of a multi-channel audio signal, said energy shaping apparatus comprising:

a splitting unit operable to split an audio signal in a sub-band domain into diffuse signals indicating a reverberating component and direct signals indicating a non-reverberating component, the audio signal being obtained by performing a hybrid time-frequency transformation;

a downmix unit operable to generate a downmix signal by downmixing the direct signals;

a filter processing unit operable to generate a bandpass downmix signal and bandpass diffuse signals by bandpassing the downmix signal and the diffuse signals per sub-band, the diffuse signals being split on the sub-band basis;

a normalization processing unit operable to generate a normalized downmix signal and normalized diffuse signals, respectively, by normalizing the bandpass downmix signal and the bandpass diffuse signals with regard to respective energy;

a scale factor computing unit operable to compute, for each of predetermined time slots, a scale factor indicating magnitude of energy of the normalized downmix signal with respect to the energy of the normalized diffuse signals;

a multiplying unit operable to generate scale diffuse signals by multiplying each of the diffuse signals by a corresponding one of the scale factors;

a high-pass processing unit operable to generate high-pass diffuse signals by highpassing the scale diffuse signals;

an adding unit operable to generate addition signals by adding the high-pass diffuse signals and the direct signals; and a synthesis filter processing unit operable to apply synthesis filtering to the addition signals and transform the addition signals into time domain signals.

2. The energy shaping apparatus according to claim 1, further comprising a smoothing unit operable to generate a smoothed scale factor by smoothing the scale factor so as to suppress a fluctuation on the time slot basis.

3. The energy shaping apparatus according to claim 2, wherein said smoothing unit is operable to perform the smoothing processing by adding:

a value which is obtained by multiplying a scale factor in a current time slot by $\alpha$; and a value which is obtained by multiplying a scale factor in an immediately preceding time slot by $(1-\alpha)$.

4. The energy shaping apparatus according to claim 1, further comprising a clip processing unit operable to perform clip processing on scale factor by limiting the scale factor to one of: an upper limit when the scale factor exceeds a predetermined upper limit; and a lower limit when the scale factor falls below a predetermined lower limit.

5. The energy shaping apparatus according to claim 4, wherein said clip processing unit is operable to set, when the upper limit is set to $\beta$, the lower limit to $1/\beta$ and perform the clip processing.

6. The energy shaping apparatus according to claim 1, wherein the direct signals include a reverberating component and a non-reverberating component in a low frequency band of the audio signal, and an other non-reverberating component in a high frequency band of the audio signal.

7. The energy shaping apparatus according to claim 1, wherein the diffuse signals include the reverberating component in a high frequency band of the audio signal, and do not include a low frequency component of the audio signal.

8. The energy shaping apparatus according to claim 1, further comprising a control unit operable selectively enable or disable energy shaping to be performed on the audio signal.

9. The energy shaping apparatus according to claim 8, wherein, in accordance with control flags which indicate whether or not the energy shaping is performed on an audio frame-to-audio frame basis, said control unit is operable to select one of: the diffuse signals when the energy shaping processing is not performed; and the high-pass diffuse signals when the energy shaping processing is performed, and said adding unit is operable to add the signals selected in said control unit and the direct signals.

10. An energy shaping method for performing energy shaping in decoding of a multi-channel audio signal, said energy shaping method comprising:

a splitting step of splitting an audio signal in a sub-band domain into diffuse signals indicating a reverberating component and direct signals indicating a non-reverberating component, the audio signal being obtained by performing a hybrid time-frequency transformation;

a downmix step of generating a downmix signal by downmixing the direct signals;

a filter processing step of generating a bandpass downmix signal and bandpass diffuse signals by bandpassing the downmix signal and the diffuse signals per sub-band, the diffuse signals being split on the sub-band basis;

a normalization processing step of generating a normalized downmix signal and normalized diffuse signals, respectively, by normalizing the bandpass downmix signal and the bandpass diffuse signals with regard to respective energy;

a scale factor computing step of computing, for each of predetermined time slots, a scale factor indicating magnitude of energy of the normalized downmix signal with respect to the energy of the normalized diffuse signals;

a multiplying step of generating scale diffuse signals by multiplying each of the diffuse signals by a corresponding one of the scale factors;

a high-pass processing step of generating high-pass diffuse signals by highpassing the scale diffuse signals;

an adding step of generating addition signals by adding the high-pass diffuse signals and the direct signals; and a synthesis filter processing step of applying synthesis filtering to the addition signals and transforming the addition signals into time domain signals.

11. The energy shaping method according to claim 10, further comprising a smoothing step of generating a smoothed scale factor by smoothing the scale factor so as to suppress a fluctuation on the time slot basis.

12. The energy shaping method according to claim 11, wherein said smoothing step includes performing the smoothing processing by adding: a value which is obtained by multiplying a scale factor in a current time slot by $\alpha$; and a value which is obtained by multiplying a scale factor in an immediately preceding time slot by $(1-\alpha)$.

13. The energy shaping method according to claim 10, further comprising a clip processing step of perform clip processing on the scale factor by limiting the scale factor to one of: an upper limit when the scale factor exceeds a predetermined upper limit; and a lower limit when the scale factor falls below a predetermined lower limit.

14. The energy shaping method according to claim 13, wherein said clip processing step includes performing the clip processing, setting the lower limit to $1/\beta$ when the upper limit is set to $\beta$.

15. The energy shaping method according to claim 10, wherein the direct signals include a reverberating component and a non-reverberating component in a low frequency band of the audio signal and an other non-reverberating component in a high frequency band of the audio signal.

16. The energy shaping method according to claim 10, wherein the diffuse signals include the reverberating component in a high frequency band of the audio signal, and do not include a low frequency component of the audio signal.

17. The energy shaping method according to claim 10, further comprising a controlling step of enabling or disabling energy shaping to be performed on the audio signal.

18. The energy shaping method according to claim 17, wherein, in accordance with control flags which indicate whether or not the energy shaping is performed on an audio frame-to-audio frame basis, said controlling step includes selecting one of: the diffuse signals when the energy shaping processing is not performed; and the high-pass diffuse signals when the energy shaping processing is performed, and said adding step includes adding the signals selected in said controlling step and the direct signals.

19. A non-transitory computer-readable medium having a program stored thereon which performs energy shaping in decoding of multi-channel audio signals, said program causing a computer to execute the steps included in said energy shaping method according to claim 10.

20. An integrated circuit which performs energy shaping in decoding of a multi-channel audio signal, said integrated circuit comprising:

a splitter which splits an audio signal in a sub-band domain into diffuse signals indicating a reverberating component and direct signals indicating a non-reverberating component, the audio signals being obtained by performing a hybrid time-frequency transformation;

a downmix circuit which generates a downmix signal by downmixing the direct signals;

a filter which generates, respectively, a bandpass downmix signal and bandpass diffuse signals by bandpassing the downmix signal and the diffuse signals per sub-band, the diffuse signals being split on the sub-band basis;

a normalization processing circuit which generates a normalized downmix signal and normalized diffuse signals by normalizing the bandpass downmix signal and the bandpass diffuse signals with regard to respective energy;

a scale factor computing circuit which computes, for each of predetermined time slots, a scale factor indicating magnitude of energy of the normalized downmix signal with respect to the energy of the normalized diffuse signals;

a multiplier which generates scale diffuse signals by multiplying each of the diffuse signals by a corresponding one of the scale factors;

a high-pass processing circuit which generates high-pass diffuse signals by highpassing the scale diffuse signals;

an adder which generates addition signals by adding the high-pass diffuse signals and the direct signals; and a synthesis filter which applies synthesis filtering to the addition signals and transforms the addition signals into time domain signals.

* * * * *